United States Patent [19]

Johnson

[11] Patent Number: 4,987,878

[45] Date of Patent: Jan. 29, 1991

[54] FUEL INJECTION SYSTEM

[76] Inventor: Jerome V. Johnson, 3440 Guildfore Ct. SE., Port Orchard, Wash. 98366

[21] Appl. No.: 369,291

[22] Filed: Jun. 21, 1989

[51] Int. Cl.[5] ..... F02M 23/00; F02M 59/00; F17D 3/01; B05B 7/26

[52] U.S. Cl. ..... 123/531; 123/533; 137/624.14; 239/412; 239/533.2

[58] Field of Search ..... 123/531, 533; 239/412, 239/533.2; 137/624.14; 251/63, 63.6, 323, 337

[56] References Cited

U.S. PATENT DOCUMENTS

| | | | |
|---|---|---|---|
| 2,552,960 | 5/1951 | Grieshaber et al. | 251/63.6 |
| 2,697,007 | 12/1954 | Wille | 239/412 |
| 3,053,461 | 9/1962 | Inglis | 137/624.14 |
| 4,771,754 | 9/1988 | Reinke | 123/533 |

*Primary Examiner*—Tony M. Argenbright
*Assistant Examiner*—Robert E. Mates
*Attorney, Agent, or Firm*—Cassidy, Vance & Tarleton

[57] ABSTRACT

A fuel injection system (10) having a unique injector (226) cooperating with a unique pump (228) for blowing fuel into the combustion chamber (20) of a diesel engine (12). A reciprocating valve (202) and diaphragm (196) in the pump assembly (174) cooperate to periodically discharge vapor, such as compressed air or steam, and fuel to the injector (26). The vapor drives a piston assembly (32) and a valve assembly (36) to admit high-pressure vapor to a mixing chamber (124). Fuel is simultaneously supplied through a fuel valve assembly (130) to a fuel distribution ring (134) in the mixing chamber (124). The high-pressure vapor or gases blow the fuel from the mixing chamber (124) into the combustion chamber (20). Alternatively, the high-pressure vapor is replaced with a combustion product from a combustion chamber (257) formed in the injector (253). Combustion fuel is supplied through an intake valve (321) and excess gases are exhausted through exhaust valve (323). Pressure from combustion gases in the chamber (257) drives the piston assembly (267) and valve assembly (271). Vapor pressure from the combustion gases also blows the fuel into the cylinder.

9 Claims, 5 Drawing Sheets

FUEL INJECTION SYSTEM

TECHNICAL FIELD OF THE INVENTION

The present invention pertains to a fuel injection system, and, more particularly, to a fuel injector that utilizes pressurized vapor to blow coal-based fuel into the engine combustion chamber.

BACKGROUND OF THE INVENTION

Coal-fueled diesel engines must achieve complete combustion of the coal fuel within a limited residence time. Complete combustion is essential to achieve desired engine performance and to reduce degradation of the engine and the environment. The ability to intermittently inject, ignite, and burn coal fuel in a diesel engine is primarily a function of the particle size and chamber residence time. The relative influences of chamber geometry, fuel characteristics, and changes in engine load on the coal particle burnout must be considered in order to maximize the burning process. However, particle agglomeration, ignition, flame development, particle burnout, emissions, and combustion efficiency are parameters affected not only by the fuel, but also the method of injecting the fuel into the engine.

Coal-based fuels currently under use are generally in the form of a coal slurry, that is, a mixture of coal particles in an approximate 50/50 mixture with water. Solid coal particles have also been used, as well as a vaporous mix of coal particles and steam, etc.

One of the major drawbacks to the use of coal-based fuel in diesel engines is the degradation of engine performance caused by coal itself and contaminants. This problem originates with the coal, the ash and unburned coal particles passing through the engine, causing accelerated wear on the injector systems, particularly on injector spray holes. In addition, these particles cause premature wear on cylinder walls, rings, valves, and exhaust components. As the injector spray holes, valve seat, and plunger erode away and change in size and shape, the direction of the fuel as it is injected into the chamber is changed. In some cases, the fuel is directed onto the piston, where a hole can subsequently be burned on the piston. In addition, plugging of the injector can result as water separates from the coal.

One proposed method of overcoming these disadvantages is to use high-pressure air to blow the solid coal particles into the combustion chamber. The difficulty here is that pneumatic pump lubricating oil tends to mix in with the high-pressure air or fuel that migrates back into the high-pressure air lines, causing serious damage or destruction of the engine. The present invention is directed to overcoming these drawbacks.

SUMMARY OF THE INVENTION

The present invention is directed to a fuel injection system for injecting fuel into a cylinder. The system comprises an injector that includes a mixing chamber formed in a housing, a valve for selectively admitting the contents in the mixing chamber to the cylinder, a pump for supplying fuel to the mixing chamber and for supplying pressurized vapor to the mixing chamber, and a pneumatic control for opening and closing the valve such that upon opening of the valve the pressurized vapor blows the fuel into the cylinder.

In accordance with another aspect of the present invention, a device for regulating fuel flow into the mixing chamber is provided. Preferably, the device comprises a pneumatic piston valve having a mushroom-shaped head and a plunger portion that rests in a seat formed in a fuel passageway in the housing. The plunger portion is lifted off the seat by the pressurized gas acting on the mushroom-shaped head to admit a previously determined quantity of fuel into the mixing chamber.

In accordance with another aspect of the present invention, a fuel distribution ring is provided in the mixing chamber for distribution of the fuel into the path of the high-pressure vapor blast.

In accordance with yet another aspect of the present invention, the pneumatic control means comprises a piston having a plunger portion, and a pneumatic lash adjuster, the piston being slidably received within a cylinder that communicates with an orifice in said housing, the piston being mounted to move between a closed position, wherein the plunger seats in said orifice, to prevent the introduction of pressurized gas, and an open position, wherein the plunger unseats from the orifice, to admit the predetermined quantity of pressurized gas.

In accordance with still yet another aspect of the present invention, the injector further includes means for periodically introducing the pressurized gas to the piston to force the piston to move from the closed position to the open position.

In accordance with an alternative embodiment of a fuel injection system for injecting fuel into a cylinder, the system comprises an injector assembly having a housing mounted over the cylinder; a mixing chamber adjacent said housing that communicates with said cylinder and in which fuel and pressurized gas are mixed; a valve for selectively permitting communication between the mixing chamber and the cylinder; a piston slidably mounted in the housing having a first end contacting the valve, a combustion chamber formed in the housing and communicating with the mixing cylinder and the piston, means for selectively admitting combustible materials into the combustion chamber, and means for igniting the combustible materials such that upon combustion, said combustion chamber is pressurized to drive the piston into the valve to push the valve open, and simultaneously the combustion gases are admitted into the mixing chamber to blow the fuel in the mixing chamber into the cylinder; and a pump for supplying a predetermined quantity of fuel under pressure to the mixing chamber.

In accordance with a further aspect of the present invention, pressurized gas is used to urge the piston away from the valve to permit the valve to close.

As will be readily appreciated from the foregoing description, the present invention provides a diesel injector system that can be used with solid fuel, liquid fuel, gaseous fuel, or a combination of any of the three. Because the fuel is blown into the cylinder using pneumatic pressure instead of hydraulic pressure, operating pressures will be lowered, erosion will be reduced, and a greater variety of fuels, such as a coal slurry, can be efficiently burned. Furthermore, the pressurized gas breaks up and injects the fuel to lower the precombustion time. In other words, the time for evaporation and the burning start time are reduced. In addition, the use of lower pressures means that normal fits instead of lapped fits can be used between moving parts, which can tolerate more wear. This also occurs because fuel is not used under high pressure and is not in contact with closely fitted parts. Finally, there is better distribution and better burning of the fuel, resulting in a reduction in cylinder wear.

BRIEF DESCRIPTION OF THE DRAWINGS

The foregoing and other features and advantages of the present invention will be more readily appreciated as the same becomes better understood from the detailed description of the invention when considered in conjunction with the following drawings, wherein.

DETAILED DESCRIPTION OF THE PREFERRED EMBODIMENT

Figure 1:
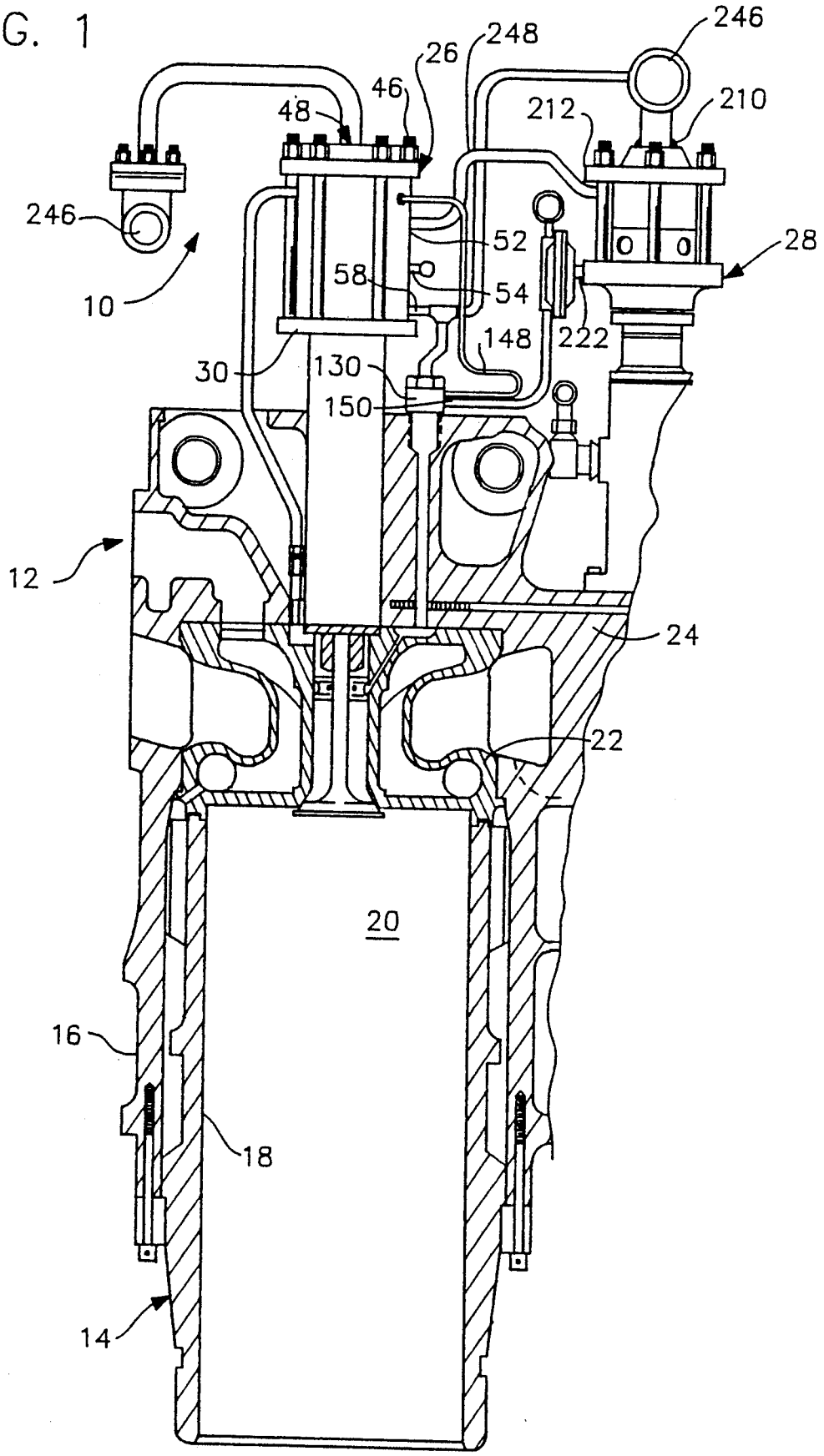
FIG. 1 is a side view and partial cross section of a fuel system formed in accordance with the present invention as installed over a typical diesel cylinder.

Referring initially to FIG. 1, a fuel injection system 10 is formed in accordance with the present invention as shown in conjunction with a diesel engine 12. For purposes of explanation, only one cylinder assembly 14 of the engine 12 is shown. However, it is to be understood that each cylinder of the diesel engine 12, whether there be one, two, four, six, etc., will utilize the diesel injection system 10 as described herein. The cylinder assembly 14 includes a block 16 having a cylinder sleeve 18 mounted therein to define a combustion chamber 20. A cylinder head 22 is mounted on the block 16 over the combustion chamber 20, and an outside casting 24 is mounted on the cylinder head 22.

The diesel injection system 10 includes an injector 26 mounted in the cylinder head 22 and a metering pump 28 mounted on the casting 24. Other components such as the piston, the intake and exhaust valves, etc., are not shown in order to simplify the description of the present invention.

Figure 2:
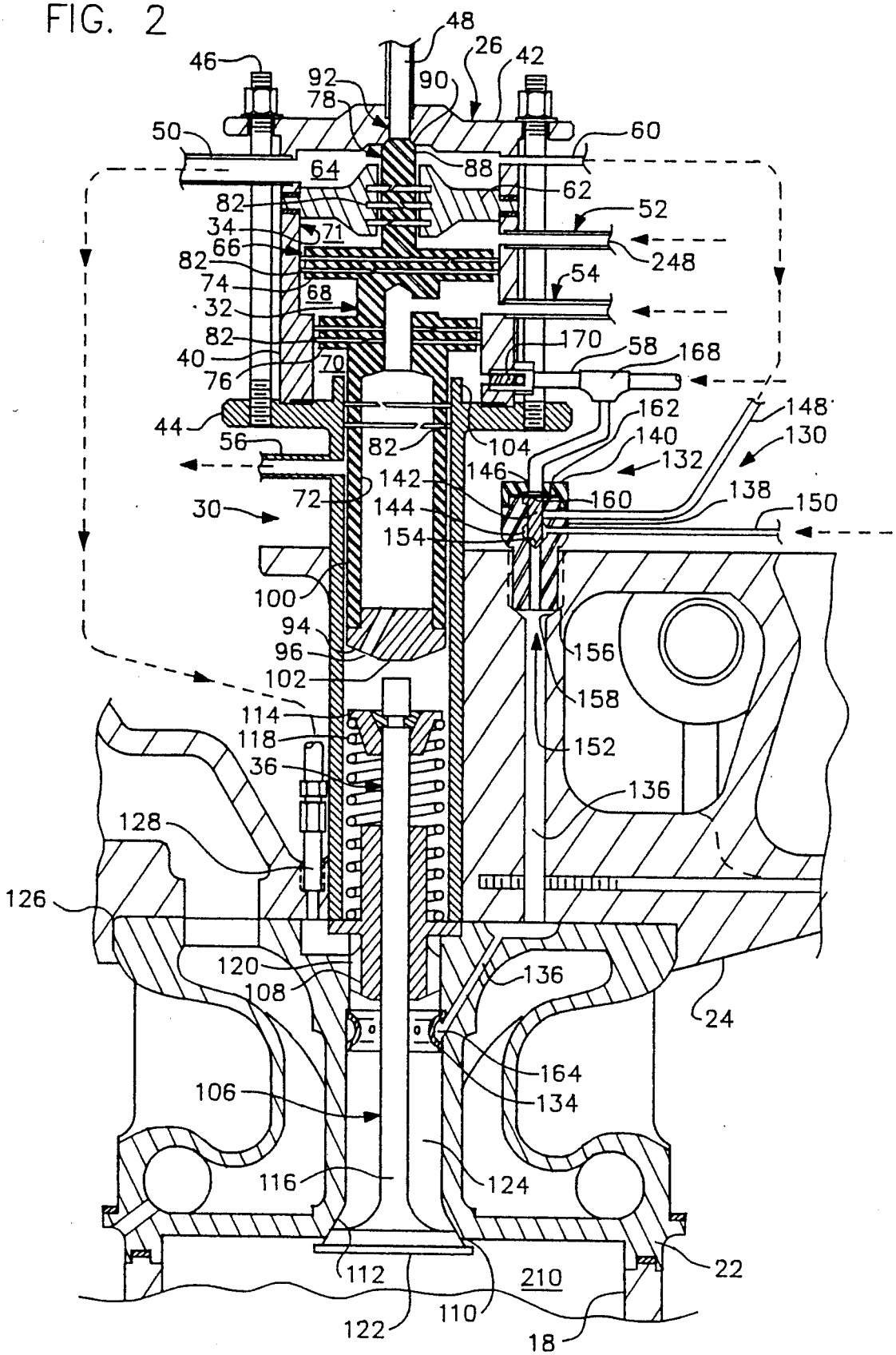
FIG. 2 is an enlarged cross-sectional view of an injector portion of the diesel injection system of FIG. 1.

As shown more clearly in FIG. 2, the injector 26 includes a housing 30, a piston assembly 32 mounted within a cylinder assembly 34 that is attached to the housing 30, and a valve assembly 36 extending from the housing 30 into the cylinder head 22. The cylinder assembly 34 comprises a cylinder block 38 formed to have a cylindrical wall 40 and an integral top 42 mounted to a flange 44 on the housing with a plurality of retaining bolts 46. A plurality of ports are formed in the wall 40 and top 42, including an injection gas inlet port 48, an injection gas exit port 50, a control fluid inlet port 52, a cooling fluid inlet port 54, cooling fluid exit port 56, and a cushioning fluid inlet port 58.

Also shown above the control fluid inlet port 52 is a fuel driving and valve lifting exit port 60 that, along with the injection gas exit port 50 and injection gas inlet port 48, are positioned above a dividing wall 62 that separates an upper chamber 64 and a lower chamber 66. The lower chamber 66 is further divided into a first cylinder 68, a second cylinder 70, and a third cylinder 71, with the first cylinder 68 having a larger diameter than the second cylinder 70. The injection gas inlet port 48, the injection gas exit port 50, and the fuel driving and valve lifting port 60 communicate with the upper chamber 64. The control fluid inlet port 52 communicates with the third cylinder 71, and the cooling fluid inlet port 54 communicates with the first cylinder 68, while the cushioning fluid inlet port 58 communicates with the second cylinder 70. The cooling fluid exit port 56 is formed on the housing 30 below the cylinder assembly 34 and communicates with the cooling fluid inlet port 54, as will be described in greater detail below.

The piston assembly 32 includes a piston shaft 72 having an integrally formed first piston 74 and second piston 76. Projecting upward from the first piston 74 is a plunger 78. The first piston 74 is separated from the second piston 76 by a shaft segment 80. The first piston 74 is sized to be slidably received within the chamber 66, and includes a plurality of sealing rings 82. Similarly, the second piston 76 is sized to be slidably received within the second cylinder 70, and it includes a plurality of sealing rings 82. The piston shaft 72 is slidably received within a lower portion 84 of the housing 30, and is provided with sealing rings 82. The plunger 78 slides through a bore 86 formed in the dividing wall 62, and it also includes sealing rings 82. The nose portion 88 of the plunger 78 has angled sides 90 that seat within an orifice 92 and form a valve in the top 42 that communicates with the injection gas inlet port 48. The piston shaft 72 is hollow, with the opening at the lower end being closed off by an end fitting 94 having a passageway 96 that permits cooling fluid to flow from the cooling fluid inlet port 54 and into the hollow shaft 72 via an opening 98 formed in the shaft segment 80.

After the cooling fluid flows through the shaft 72 and the passageway 96, it passes up through a clearance space 100 between the piston shaft 72 and the housing 30, and then it passes out of the housing 32 through the cooling exit port 56. The end fitting 94 angles down to a contact face 102 that contacts the valve assembly 36 when the piston assembly 32 slides downward in the housing 30. Upward movement of the piston assembly 32 is checked by the plunger 78 contacting the orifice 92. Downward motion of the piston assembly 32 is checked when the second piston 76 contacts a travel limiter 104 formed on the flange 44 in the housing 30.

The valve assembly 36 comprises a poppet-type valve 116 slidably received within the housing 30 through a valve guide and nozzle 108. The valve 106 includes angled faces 110 that contact a valve seat 112 formed in the cylinder head 22. A spring keeper 114 is held in place on the valve shaft 116. A compression spring 118 is mounted over the valve shaft 116, and has one end bearing against the valve guide and nozzle 108 and the other end bearing against the spring keeper 114 to urge the angled faces 110 into contact with the valve seat 112. The space formed between the valve guide 108 and the head 122 of the valve 106 comprises a mixing chamber 124. The valve guide 108 includes flutes 120 to permit fluid communication between the injection gas exit port 50 and the mixing chamber 124. The cylinder head 22 includes a milled passageway 126 that has a receiving port 128 to receive the injection gas from the upper chamber 64 and also opens to the flutes 120 on the valve guide 108.

Associated with the injector 26 is a fuel valve assembly 130 comprising a fuel valve 132 mounted on the outside casting 24 and a fuel distribution ring 134 mounted in the mixing chamber 124 that communicates with the fuel valve 132 through fuel passageways 136 formed in the cylinder head 22 and the outside casting 124. The fuel valve 132 includes a valve body 138, a cap 140 attached on top of the valve body 138, and a piston valve 142 slidably received within a valve chamber 144 inside the valve body 138. The cap 140 has a cushioning fluid entry port 146 to admit a cushioning fluid to the valve chamber 144. An injection gas entry port 148 and fuel entry port 150 are formed in the side of the valve body 138 to communicate with the valve chamber 144. An exit orifice 152 is formed at the other end of the valve body 138 to permit fluid communication between the valve chamber 144 and the fuel passageways 136.

The lower end 154 of the piston valve 142 has angled faces 156 that seat within an orifice valve seat 158 to prevent fluid flow between the valve chamber 144 and the fuel passageways 136. The top end of the piston valve 142 has a mushroom-shaped head 160 that bears against a flexible diaphragm 162 that is positioned across the valve chamber 144 to prevent fluid communication between the cushioning fluid entry port 146 and the valve chamber 144. Pressurized cushioning fluid 146 pressing on the diaphragm 162 forces the valve body 138 to seat in the orifice valve seat 158 to shut off fuel flow to the fuel passageways 136. When pressurized injection gas is forced through the injection gas entry port 148, the injection gas contacts the underside of the head 160, forcing the piston valve 142 to move upward and unseat from the valve seat 158. Pressurized fuel entering the fuel port 150 is then permitted to flow through the exit orifice 152 and the fuel passageways 136 to the fuel distribution ring 134. A loose fit between the valve body 138 and the piston valve 142 allows fuel to be scavenged from between the valve body 138 and the piston valve 142 and helps move fuel along passage 136.

As shown in FIG. 2, the fuel distribution ring 134 is cylindrically shaped having a circumferential groove 164 that communicates with the fuel passageway 136. The fuel passes through the opening formed by the groove 164 and exits through slightly smaller openings (not shown) in the inside face of the fuel distribution ring 134. At this point, the fuel is broken into smaller droplets to aid in atomization and mixing in the mixing chamber 124.

In operation, the plunger 78 is initially seated in the orifice 92 by pressurized steam at approximately 150 psi supplied at the cushioning fluid inlet port 58 that acts upon the second piston 76 to force it upward in the second cylinder 70. The cushioning fluid is also supplied to the fuel valve 132 through a T connector 168 to urge the flexible diaphragm 162 against the piston valve 142 to close off the fuel passageways 136. Cooling fluid is continuously flowing through the injector 26 by being pumped through the cooling fluid entry port 54, passing through the hollow piston shaft 72, and exiting the cooling exit port 56. A compressible vapor is to be pumped through the cooling ports. Fuel is also supplied under primary fuel pressure from a primary fuel pump (not shown) to the fuel entry port 150 in the metering valve 132, and at a higher pressure during metering pump 28 strokes.

High-pressure vapor, such as steam in the range of 650 to 2000 psi is supplied to the injection gas entry port 48. Control fluid is supplied at about 100–150 psi to the control fluid inlet port 52 from the metering pump 28, as described more fully below. This control fluid entering the control port 52 acts on the top surface of the first piston 74 to force it downward in the housing 30. The piston area differential allows the higher pressure vapor to overcome the cushion fluid pressure acting on the second piston 76. As the piston assembly 32 moves downward in the housing 30, the contact face 102 on the piston shaft end fitting 94 contacts the valve stem 116 and forces the valve 106 downward, overcoming the force of the compression spring 118.

The high-pressure vapor supplied at injection gas entry port 48 is admitted to the upper chamber 64 when the piston assembly moves the plunger 74 downward, causing it to unseat from the orifice 92. The high-pressure vapor exits the upper chamber 64 in two directions, through the injection gas exit port 50 and into the mixing chamber through the receiving port 128 and passageway 126 at the valve guide 108. The steam also passes through the fuel metering exit port 60 and into the fuel metering valve 132 to force the piston valve 142 upward and admit a predetermined quantity of fuel through the fuel passageways 136 and the fuel distribution ring 134. The atomized fuel entering the mixing chamber 124 is blown past the opened valve 106 by the high-pressure steam and into the combustion chamber 20.

Upon cessation of the supply of control fluid at the control fluid entry port 52, the resilient pressure of the compression spring 118 and the pressure of the cushion fluid on the second piston 76 urges the valve 106 and the piston assembly 32 to move upward in the housing 30, with the valve 106 seating in the cylinder head 22 and the plunger 76 seating in the orifice 92. The cushion fluid entering the fuel metering valve 132 overcomes the lowering pressure from the high-pressure steam and forces the fuel metering valve downward to close off the fuel exit orifice 152. Because the piston valve 142 is loosely seated within the valve body 138, high-pressure steam from the entry port 148 is permitted to blow by the piston valve 142 when it is open to prevent the backflow of fuel into the high-pressure steam lines and to maintain the orifice valve seat 158 clear of fuel particles. In addition, to prevent the backflow of cushion fluid into the connector 168 as the second piston 76 moves downward in the second cylinder 70 and to maintain air pressure equilibrium between cylinders 70 and 71, a check valve 170 is placed at the cushioning fluid inlet port 58 to admit cushioning fluid in one direction only into the second cylinder 70. The first cylinder 68 will undergo a change in volume as the piston strokes and will collect blow-by vapor.

The injector shown in FIG. 2 has been adapted to fit on a General Electric engine, Model No. 7FDL, available through General Electric Corporation located in Erie, Pa. In some engines, the fuel metering valve 132, the outside high-pressure steam lines between the exit ports 50 and 60 and the inlet ports 128 and 148 would be all contained within the housing 30. Similarly, the fuel valve assembly 130 would also be contained within the housing 30.

Figure 3:
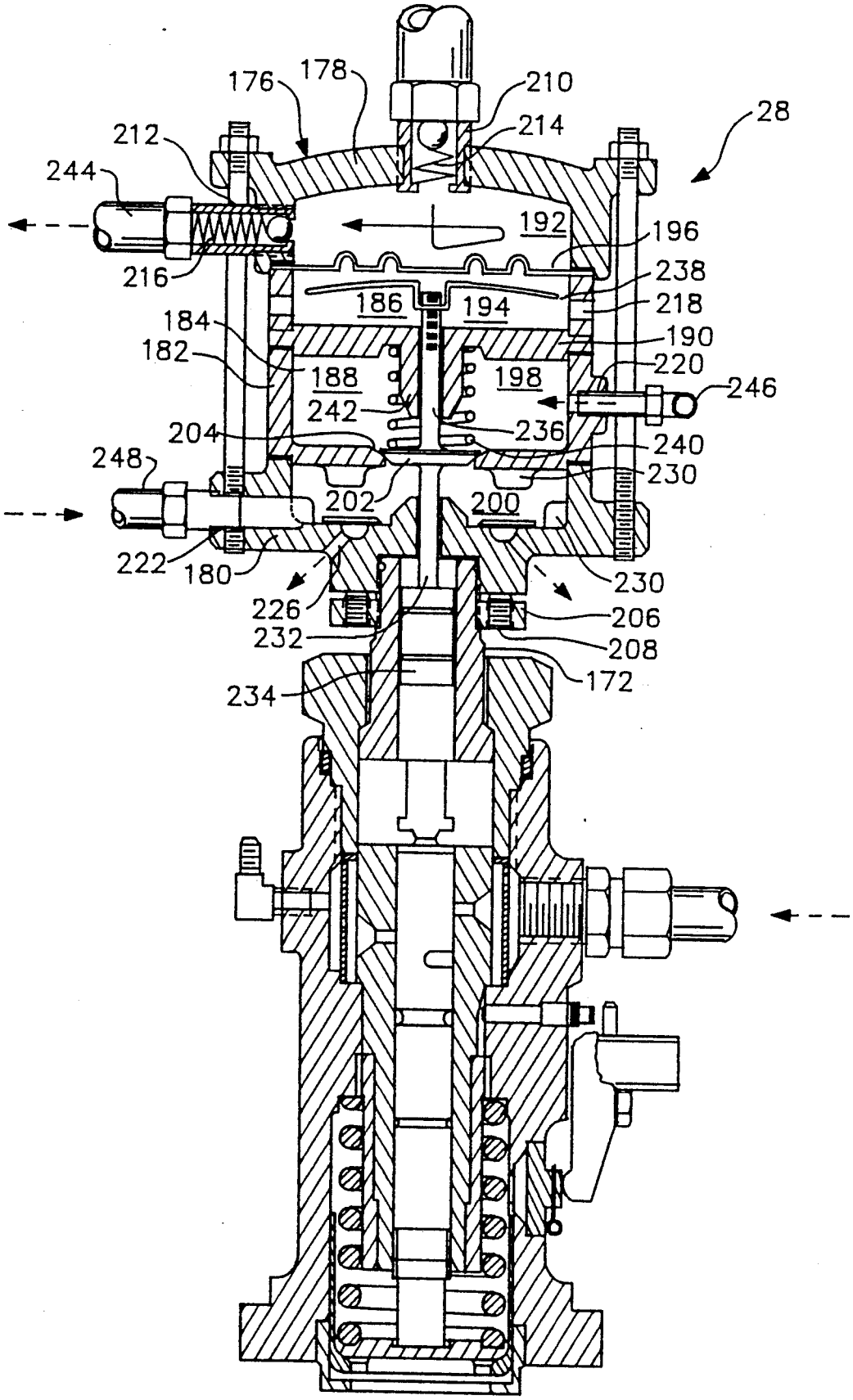
FIG. 3 is an enlarged cross-sectional view of a pump portion of the diesel injection system of FIG. 1 for use with the injector of FIG. 2.

FIG. 3 illustrates the metering pump 28 used to supply fuel and control vapor to the injector 26. This particular pump 28 is a modification of a standard fuel-injection pump, Model No. GEK-18175, available from General Electric Corporation, located in Erie, Pa. It is to be understood that this is a representative pump, and in other pumps may be similarly modified in accordance with the present invention. The lower half of the pump 28 includes the standard housing and plunger-and-barrel assembly while the top half, to be described below, is modified in accordance with the present invention. More particularly, the delivery valve holder and high pressure jumper tube receiver of an existing pump are modified to receive the novel pump assembly 174. The assembly 174 includes a housing assembly 176 formed of a top housing member 178, a bottom housing member 180, and a generally cylindrical cylinder wall 182 that defines a cylinder 184. The cylinder 184 is divided into an upper chamber 186 and a lower chamber 188 by a fixed dividing wall 190 placed across the cylinder 154. The upper chamber 186 is further divided into a fuel chamber 192 and a follower chamber 194 by a flexible diaphragm 196.

Similarly, the lower chamber 188 is divided into a control-pressure gas entry chamber 198 and a control-pressure gas exit chamber 200 by a valve 202 and seat 204. The bottom housing member 180 is threadably mounted to the existing valve holder 172 and is held in place by a mounting member 206 attached to the valve holder 172 and fasteners 208 projecting through the mounting member 206 and into the bottom housing 180.

Fuel for the pump 28 is supplied from a fuel header (not shown) under pressure to the fuel chamber 192 through a fuel inlet port 210, and it exits the fuel chamber 192 through a fuel exit port 212. Check valves 214 and 216 are positioned at the inlet port 210 and exit 212, respectively, to prevent the backflow of fuel through the pump 28. Although ball check valves are shown, other types of check valves known in the art may also be used. Breathing holes 218 maintain the follower chamber 194 at atmospheric pressure. A control-pressure gas inlet port 220 is formed in the cylinder wall 182 to communicate with the control-pressure gas entry chamber 198. Similarly, a control-pressure gas exit port 222 is formed in the bottom housing member 180 to communicate with the control-pressure gas exit chamber 200.

Finally, exhaust ports 226 are formed in the bottom housing member 180 and communicate with the control-pressure gas exit chamber 200 to permit the exhaust of gas being returned to the control-pressure gas exit chamber 200 through the exit port 222. A quick-release valve plate 228 normally covers the exhaust ports 226, and it is lifted from the exhaust ports 226 by the reverse flow of gas through the exit port 222. Guide fins 230 are positioned around the interior of the exit chamber 200 to limit movement of the quick-release valve plates 228 in a horizontal and vertical direction.

The valve 202 is a poppet-type valve having a lower stem 232 that projects through the bottom housing member 180 and into the valve holder 172. A piston 234 is attached to the other end of the lower stem 232 to interact with the lower pump assembly which imparts reciprocating vertical motion to the valve 202. An upper stem 236 projects upward from the valve 202 through the dividing wall 190 and into the follower chamber 194. Attached to the top of the upper stem 236 is a mushroom follower 238 that bears against the diaphragm 196 to urge it upward when the pump moves the valve 202 upward. A compression spring 240 is placed around the upper stem 236 and has one end bearing against the valve 202, and the other end bearing against the divider wall 190 to urge the valve 202 to seat against the valve seat 204. A valve guide 242 is integrally formed with the dividing wall 190 to project downward around the upper stem 236.

In operation, fuel is supplied through the fuel inlet port 210 to the fuel chamber 192. Upward movement of the valve 202 by the lower pump assembly causes the follower 238 to urge the diaphragm 196 upward, pressurizing the fuel chamber 192. The increased pressure of the fuel in the fuel chamber 192 overcomes the pressure of the ball check valve 216 to allow a predetermined quantity of the fuel in the fuel chamber 192 to exit through the exit port 212. The exit port 212 is attached by a suitable tube 244 to the fuel inlet port 150 on the injector 26.

As the valve 202 is lifted by the lower pump assembly, it is raised off the valve seat 204 to permit fluid communication between the control-pressure vapor entry chamber 198 and the control-pressure gas exit chamber 200. In this embodiment of the invention, vapor or steam in the range of 100 to 150 psi is supplied to the control-pressure vapor inlet port 220 via a manifold 246. The vapor passes through the entry chamber 198, past the open valve 202, and through the exit chamber 200 to the exit port 222. The vapor then passes through a control-pressure tube 248 (shown in FIG. 1) to the control fluid inlet port 52. The cushioning fluid inlet port 58 also receives vapor from the vapor manifold 246. Alternatively, a second source of vapor, steam, or compressed air may be used to supply steam or vapor at a low pressure to the cushioning fluid inlet port 58 and the control fluid inlet port 52.

When vapor passes through the exit chamber 200, the quick-release valve 250 is forced down over the exhaust ports 226 to prevent the escape of a substantial amount of vapor. The quick-release valve 250 comprises a circular flat plate sized and shaped to be received in the exit chamber 200 and form a tight seal over the exhaust ports 226.

After the lower pump assembly releases pressure on the valve 202, the compression spring 240 urges the valve 202 downward and into contact with the valve seat 204, thus preventing fluid communication between the two chambers 198 and 200. In this condition, vapor will flow back through port 222, causing the quick-release valve 250 to unseat. In other words, when the piston assembly 32 in the injector 26 is moved upward after pressure in cylinder 71 is released, high-pressure vapor trapped in the lower chamber 66 and in the cylinder assembly 34 becomes pressurized, possibly interfering with the upward travel of the piston assembly 32. However, as pressure builds up in the lower chamber 66 and the steam tube 248, the quick-release valve 250 in the pump assembly 174 is forced upward to uncover the exhaust ports 226 and relieve the pressure. The guide fins 230 aid in maintaining the quick-release valve 250 in the proper position as it is moving up and down in the exit chamber 200. Once the pressure in the exit chamber 200 is reduced to atmospheric pressure, the quick-release valve 250 falls by the force of gravity to cover the exhaust ports 226.

Figure 4:
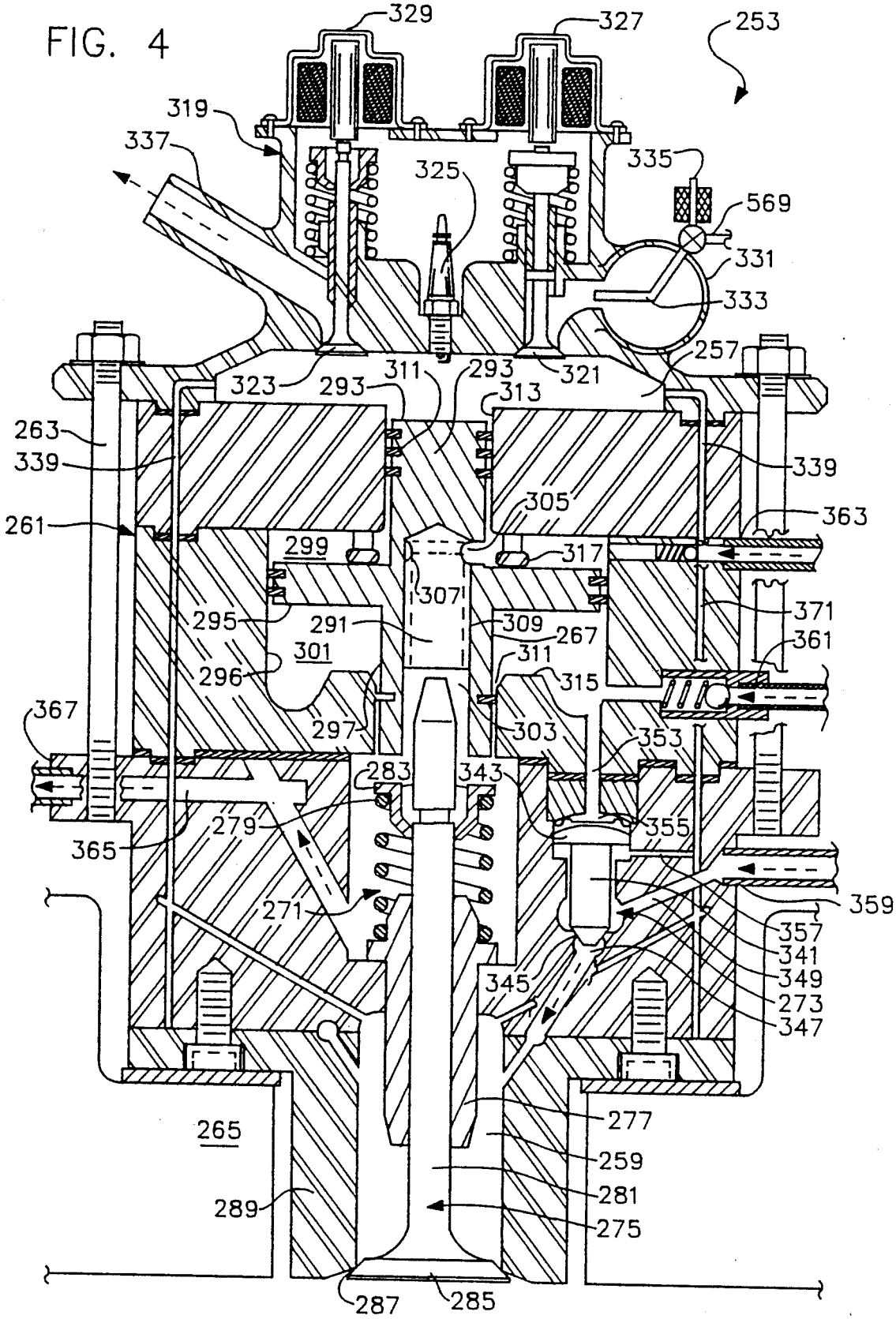
FIG. 4 is an enlarged cross-sectional view of an alternative embodiment of an injector formed in accordance with the present invention; and, FIG. 5 is an enlarged cross-sectional view of an alternative embodiment of a pump formed in accordance with the present invention for supplying fuel to the injector of FIG. 4.
Figure 5:
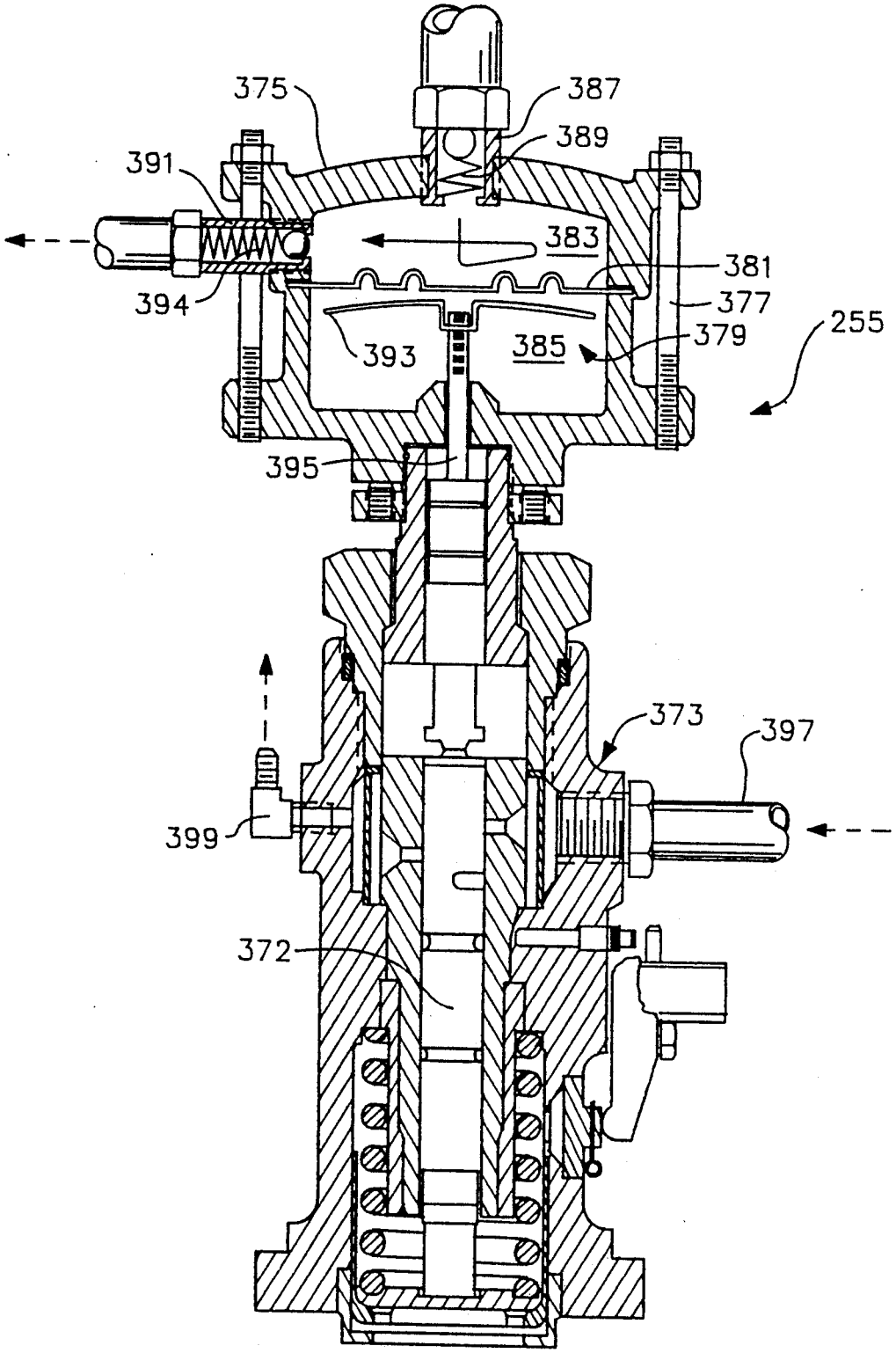

FIGS. 4 and 5 illustrate alternative embodiments of an injector 253 and metering pump 255. The injector 253 utilizes an auxiliary combustion chamber 257 to supply high-pressure gas to an adjacent mixing chamber 259 instead of using high-pressure steam. However, the operation of the injector 253 utilizes the same principles as the injector 26 described above.

The injector 253 comprises a multipart housing 261 held together by bolts 263 and mounted to a cylinder head 265, a piston assembly 267 slidably mounted in a cylinder 269 in the housing 261, a valve assembly 271 positioned below the piston assembly 267, and a fuel valve assembly 273 formed within the housing 261. The valve assembly 271 is substantially the same as the valve assembly 36 of FIG. 2. It includes the valve 275, the valve guide 277, the compression spring 279 mounted over the stem 281 of the valve 275 and bearing against the valve guide 277, and a retaining ring 283 attached to the end of the stem 281. The spring 279 urges the head 285 of the valve 275 into contact with a seat 287 formed on the lower end 289 of the housing 261. Positioned above the stem 281 is an automatic pneumatic valve lash adjuster 294 that maintains proper clearance between the valve and the piston assembly 267.

The piston assembly 267 has an upper piston 293 integrally formed with a lower piston 295 and a plunger 297. The lower piston 295 has a larger diameter than the upper piston 293, and is slidably received within the cylinder 269 to divide the cylinder into an upper chamber 299 and a lower chamber 301. The plunger 297 has an internal axial bore 303 that communicates with the upper chamber 229 through an opening 305 formed just above the lower piston 295. The valve lash adjuster 291 is slidably received within the bore 303. The adjuster 291 includes an annulus 307 communicating with the opening 305 and a plurality of longitudinal grooves 309 formed in the adjuster 291 to permit fluid communication between the upper chamber 299 and the bore 303.

Rings 311 provide fluid sealing between the lower piston 295 and the walls of the cylinder 269, and between the upper piston 293 and the interior walls 313 of the housing 261. An upper stop 317 in the cylinder 269 limits upward movement of the piston assembly 267, and a lower stop 315 in the cylinder 269 limits downward movement of the piston assembly 267.

The multipart housing 261 includes a head assembly 319 mounted thereon to form the auxiliary combustion chamber 257. The head assembly includes an intake valve 321, an exhaust valve 323, and a spark plug 325. An intake valve solenoid 327 and an exhaust valve solenoid 329 electronically control the movement of the valves 321 and 323. An air manifold 331 provides a combustion gas to the intake valve 321, and a fuel delivery tube 333 provides a combustible fuel to the intake valve 321. A fuel valve solenoid 335 controls the amount of fuel delivered by the intake valve 321. The valve solenoids 327 and 329 and the fuel valve solenoid 335 may be controlled electronically by engine flywheel position and a governor setting. Electronic control is specified so that the injector timing may be easily changed to suit fuel characteristics while the engine is running. An exhaust port 337 carries unneeded exhaust gases away from the auxiliary combustion chamber 257.

When the intake solenoid 327 opens the intake valve 321, pressurized air in the air manifold 331 is admitted to the auxiliary combustion chamber 257. Simultaneously, the fuel valve solenoid 335 admits a predetermined quantity of combustible fuel to the intake valve 321 and into the chamber 257. Because the amount of air pressure in the air manifold 331 is low, approximately 150 psi, the compression inside the chamber 257 will also be low when the intake valve 321 is closed. The combustion chamber 257 communicates with the mixing chamber 259 through passageways 339.

In order to pressurize the combustion chamber 257, the valve 281 must be closed. Ignition of the combustible mixture in the chamber 257 is commenced by firing of the spark plug 325. As pressure builds up as a result of combustion, the upper piston 293 is driven downward to force the valve lash adjuster 291 into contact with the valve stem 281 and drive the valve 275 downward to unseat. As this occurs, the gases in the chamber 257 flow through the passageway 339 and the mixing chamber 259 and into the engine combustion chamber (not shown). When pressure is sufficiently reduced, the compression spring 279 forces the valve 281 to move upward and seat against the housing seat 287. The upward movement of the valve 281 forces the piston assembly 267 to move upward. To release pressure in the chamber 257, the exhaust solenoid 329 opens the exhaust valve 323 and the remaining pressurized exhaust gases are permitted to escape.

The fuel valve assembly 273 is essentially the same as the fuel valve assembly 130 described in conjunction with FIG. 2. Briefly, the fuel valve assembly 273 includes a piston valve 341 having a mushroom-shaped head 343 on one end and angled faces 345 at the other end that coact with a seat 347 to seal off a fuel passageway 349. The piston valve 341 is received within a valve chamber 351 having a cushioning fluid inlet port 353 at the top thereof. A flexible diaphragm 355 is positioned across the cushioning fluid inlet port 353 to bear against the head 343 of the piston valve 341. Fluid pressure from the cushioning fluid inlet port 353 urges the diaphragm 355 against the piston valve 341, causing the angled faces 345 to contact the seat 347 and seal off the fuel passageway 349 from the mixing chamber 259. The inlet passageway 357 communicates with the passageway 339 and the combustion chamber 257 to allow pressurized gases to contact the bottom of the mushroom head 343 to force the piston valve 341 upward in the valve chamber 351, thus unseating the angled faces 345 and permitting a predetermined quantity of fuel to flow from the fuel passageway 349 into the mixing chamber 259.

Fuel is supplied to the fuel passageway 349 through a fuel inlet port 359. Cushioning fluid is supplied to the injector 253 at the cushioning fluid inlet port 361 to apply pressure to the diaphragm 355 in the fuel metering assembly 273 and to the bottom side of the large-diameter piston 295 and the cylinder 269. Cooling fluid is supplied to the injector 253 at the cooling fluid inlet port 363 that communicates with upper chamber 299 and the opening 305. Cooling fluid flows through the opening 305 and around the annulus 307 in the valve adjuster 291 and then down through the grooves 309 to the valve assembly 275. The cooling fluid then exits the injector housing 261 to cooling fluid passageway 365 and out the cooling fluid exit port 367. Finally, combustion fuel for the combustion chamber 257 is applied to the fuel solenoid 335 through a combustion fuel supply tube 569. A check valve 371 prevents the backflow of cooling fluid through the cooling fluid inlet port 363.

In operation, the main valve 275 is closed, and cushioning fluid holds the piston valve 341 closed. The intake valve solenoid 327 opens the intake valve to admit a predetermined quantity of pressurized air from the air header 331 and simultaneously the fuel solenoid 335 permits a predetermined quantity of combustion fuel to be supplied to the intake valve 321 and into the combustion chamber 257. When the valve 321 closes, the spark plug 325 fires to ignite the combustion mixture in the chamber 257. As combustion increases the pressure in the chamber 257, the upper piston 293 is driven downward to overcome the pressure of the compression spring 279 and open the main injector valve 275. Simultaneously, the pressurized combustion gases in the chamber 257 travel through passageways 339 to the fuel valve assembly 273 and the mixing chamber 259. The pressurized combustion gases cause the piston valve 341 to unseat and admit a predetermined quantity of fuel to the mixing chamber 259. The pressurized gases flowing through the mixing chamber 259 atomize the entering fuel and blow it into the diesel engine combustion chamber. As the pressure from the combustion gases subsides, the compression spring 279 and pressure in chamber 301 force the valve 275 to move upward and contact the seat 287. The valve stem 281 simultaneously forces the piston assembly 267 to move upward. At the same time, the cushioning pressure in the diaphragm 355 forces the piston valve 341 downward to contact the seat 347 and close, preventing the further flow of fluid. The piston valve 341 can be constructed to have a loose fit in the valve chamber 351 to allow some blow-by of high-pressure gases from the inlet passageway 357 to keep the fuel in the fuel passageway 349 from collecting around the piston valve 341. Finally, the exhaust solenoid 329 opens the exhaust valve 323 to release any excess combustion gases through the exhaust port 337.

FIG. 5 illustrates a modified pump 255 for supplying fuel to the fuel inlet port 359 on the injector 253. The pump 255 is mounted on a standard fuel injection pump assembly 373 such as is found in a typical General Electric fuel injection pump, as previously described. The pump 255 functions substantially the same as the pump 28 described in conjunction with FIG. 3, the chief difference being that the pump 255 eliminates the valves for regulation of control-pressure steam, vapor, or gas.

The pump 255 includes a housing 375 held together by bolts 377 to form a hollow interior 379. A flexible diaphragm 381 divides the interior 379 into an upper chamber 383 and a lower chamber 385. A fuel inlet port 387 admits fuel to the upper chamber 383 through a check valve 389. A fuel exit port 391 carries pressurized fuel away from the upper chamber 383 through a check valve 394. A mushroom follower 393 is mounted on a hydraulic piston 395 to slide up and down in the lower chamber 385 for forcing the diaphragm 381 up and down. The movement of the diaphragm 381 periodically increases the pressure of fuel in the upper chamber 383 to overcome the pressure of the check valve 393 to discharge a predetermined quantity of fuel to the fuel exit port 391. The piston 395 cooperates with the plunger assembly 372 and the lower portion 373 of the pump 255 to periodically move the mushroom follower 393 up and down. A suitable cooling fluid, such as hydraulic fluid, is admitted to the cooling inlet port 397 and discharged through the cooling exit port 399.

While a preferred embodiment of the invention has been illustrated and described herein, it is to be understood that various changes can be made therein without departing from the spirit and scope of the invention. Furthermore, while the invention has been described in the context of diesel engines, it is to be understood that it will have other applications, such as a pulsed burner to fire boilers. Consequently, the invention is to be limited only by the scope of the appended claims.

The embodiments of the invention in which an exclusive property or privilege is claimed are defined as follows:

1. A fuel injection system for injecting fuel into a combustion chamber, the system comprising:

an injector, the injector including:

(a) a mixing chamber;

(b) a valve means for selectively admitting contents in said mixing chamber to the combustion chamber;

(c) a pneumatic control means for opening and closing said valve means;

(d) means for supplying fuel to said mixing chamber and for supplying a pressurized vapor to said pneumatic control means and to said mixing chamber such that when said pneumatic control means opens said valve means, the pressurized vapor admitted to the mixing chamber blows the fuel into the combustion chamber; and (e) means for regulating fuel flow into said mixing chamber, said regulating means comprising a pneumatic piston valve having a plunger portion that seats in a fuel passageway upstream from said mixing chamber such that pressurized vapor admitted to said pneumatic piston lifts said plunger portion out of the fuel passageway to admit a predetermined quantity of fuel into said mixing chamber.

2. The system of claim 1, further including a fuel distribution means mounted in said mixing chamber to introduce fuel into the path of said pressurized vapor as said vapor and said fuel enter said mixing chamber.

3. A fuel injection system for injecting fuel into a combustion chamber, the system comprising:

an injector assembly, the injector assembly including:

(a) a mixing chamber;

(b) a passageway for conveying a fuel to said mixing chamber;

(c) a passageway for conveying a pressurized gas to said mixing chamber;

(d) a valve for selectively admitting a mixture of fuel and pressurized gas contained in said mixing chamber into the combustion chamber;

(e) means for pneumatically controlling the supply of pressurized gas to said gas passageway and for selectively opening and closing said valve;

(f) a pump means for supplying a predetermined quantity of pressurized gas to operate said pneumatic control means and for supplying a predetermined quantity of pressurized fuel to said fuel passageway; and (g) a source of pre-pressurized gas for supplying pressurized gas to said gas passageway through said pneumatic control means.

4. The system of claim 3, wherein said pneumatic control means comprises a piston having a plunger portion, said piston being slidably received within a cylinder that communicates with a pressurized gas inlet orifice in a housing, said piston being movable in said cylinder between a closed position, wherein said plunger seats in said pressurized gas inlet orifice, and an open position, wherein said plunger unseats from said pressurized gas inlet orifice to admit the predetermined quantity of pressurized gas to said pressurized gas passageway.

5. The system of claim 4, further comprising means for regulating the flow of the predetermined quantity of fuel into said mixing chamber.

6. The system of claim 5, wherein said regulating means comprises a pneumatic piston valve having a plunger portion that rests in a seat in said fuel passageway to block the passage of fuel such that pressurized gas acting on said pneumatic piston valve lifts said plunger off said seat to admit fuel into said mixing chamber.

7. A fuel injection system for injecting fuel into a combustion chamber, the system comprising:

an injector, the injector including:

(a) a housing adapted to be mounted over the combustion chamber;
(b) a mixing chamber adjacent said housing;
(c) a passageway means for conveying fuel to said mixing chamber;
(d) an auxiliary combustion chamber formed in said housing;
(e) a passageway means for conveying pressurized combustion vapors from said auxiliary combustion chamber to said mixing chamber;
(f) a valve for selectively admitting a mixture of fuel and pressurized vapor contained in said mixing chamber into the combustion chamber;
(g) a piston slidably mounted in said housing having a first end contacting the valve and a second end communicating with said auxiliary combustion chamber;
(h) means for selectively admitting combustible materials into said auxiliary combustion chamber;
(i) means for igniting the combustible materials in said auxiliary combustion chamber such that, upon combustion, said combustion vapors pressurize said combustion chamber and drive said piston into said valve to push said valve open, and simultaneously said combustion vapors formed in said auxiliary combustion chamber are admitted into said mixing chamber through said combustion vapor passageway means to blow fuel in said mixing chamber into the combustion chamber; and a pump for supplying a predetermined quantity of fuel under pressure to said mixing chamber.

8. The system of claim 7, further comprising means for regulating fuel flow into said mixing chamber.

9. The system of claim 8, wherein said fuel regulating means comprises a pneumatic piston valve having a plunger portion that seats in a fuel passageway formed in said housing upstream from said mixing chamber such that pressurized vapor admitted to said pneumatic piston lifts said plunger out of said fuel passageway to admit a predetermined quantity of fuel into said mixing chamber.

* * * * *